US006591442B2

(12) United States Patent
Kaminstein

(10) Patent No.: US 6,591,442 B2
(45) Date of Patent: Jul. 15, 2003

(54) FLEXIBLE MOP BASE

(75) Inventor: Bruce Kaminstein, Blauvelt, NY (US)

(73) Assignee: Kaminstein Imports, Inc., Blauvelt, NY (US)

( * ) Notice: Subject to any disclaimer, the term of this patent is extended or adjusted under 35 U.S.C. 154(b) by 0 days.

(21) Appl. No.: 09/776,646

(22) Filed: Feb. 9, 2001

(65) Prior Publication Data

US 2002/0120996 A1 Sep. 5, 2002

(51) Int. Cl.[7] ..... A47L 13/20

(52) U.S. Cl. ..... 15/228; 15/229.8; 15/231; 15/244.1; 15/244.2; 15/244.3

(58) Field of Search ..... 15/228, 231, 244.1–244.3, 15/147.2, 229.4, 229.8, 247

(56) References Cited

U.S. PATENT DOCUMENTS

| | | | | | |
|---|---|---|---|---|---|
| 1,998,634 | A | | 4/1935 | Oberti | 15/231 |
| 2,469,060 | A | * | 5/1949 | Vosbikian et al. | 15/244.2 X |
| 2,678,458 | A | * | 5/1954 | Vosbikian et al. | 15/244.2 X |
| 2,694,210 | A | * | 11/1954 | Bitzer et al. | 15/244.1 X |
| 2,722,704 | A | | 11/1955 | Warden | 15/153 |
| 2,865,036 | A | * | 12/1958 | Poritz | 15/244.1 X |
| 2,897,528 | A | * | 8/1959 | Greenleaf | 15/244.1 |
| 2,898,617 | A | * | 8/1959 | Dunbar | 15/244.1 X |
| 3,012,264 | A | * | 12/1961 | Nash | 15/231 |
| 3,085,271 | A | | 4/1963 | Janssen | 15/147.2 |
| 3,099,855 | A | * | 8/1963 | Nash | 15/231 |
| 3,287,756 | A | * | 11/1966 | Gesell | 15/244.1 X |
| 4,766,632 | A | | 8/1988 | Murray | 15/147.1 |
| 4,799,283 | A | | 1/1989 | Haydon | 15/229.1 |
| 4,893,369 | A | * | 1/1990 | Johnson | 15/244.1 X |
| 4,945,599 | A | * | 8/1990 | Flynn | 15/244.3 |
| 4,991,250 | A | | 2/1991 | Young | 15/228 |
| 5,253,387 | A | | 10/1993 | Kresse et al. | 15/228 |
| 5,343,587 | A | | 9/1994 | Findley | 15/228 |
| 5,390,390 | A | | 2/1995 | Kresse et al. | 15/228 |
| 5,426,809 | A | | 6/1995 | Muta | 15/228 |
| 5,461,749 | A | | 10/1995 | Ahlberg et al. | 15/228 |
| 6,098,239 | A | | 8/2000 | Vosbikian | 15/228 |

FOREIGN PATENT DOCUMENTS

| | | | | |
|---|---|---|---|---|
| DE | 3411858 | * | 8/1985 | 15/228 |
| FR | 1142997 | * | 9/1957 | 15/244.1 |
| GB | 1033314 | * | 6/1966 | 15/244.2 |

* cited by examiner

*Primary Examiner*—Mark Spisich
(74) *Attorney, Agent, or Firm*—Stephen E. Feldman, P.C.

(57) ABSTRACT

The present invention is directed to a flexible mop base. The mop base comprises of a top layer and a bottom absorption layer attached to the top layer. The mop base further comprises at least one flexible end, wherein this flexible end is attached to the mop base through an attachment mechanism. The attachment mechanism allows the end to freely rotate from horizontal to perpendicular position with respect to the mop base. The mop base further comprises a handle attached to the top layer and capable of free rotation. The handle has a mop holder socket attached to it, which is also free to rotation to accommodate a user of the mop base when cleaning different surfaces.

20 Claims, 3 Drawing Sheets

FLEXIBLE MOP BASE

FIELD OF INVENTION

The present invention is directed towards a mop base. Specifically the present invention relates a flexible mop base. The flexible mop base has an absorption bottom level and a top level fabricated from plastic or comparable material. The mop has a flexible edge that is capable of rotating up to ninety degrees of arc to accommodate different types of surfaces during a process of cleaning. Furthermore, the mop has a handle attachment mechanism that allows a user of the mop base to twist and turn the mop base so that it reaches all desirable surfaces.

BACKGROUND OF THE INVENTION

There are many well-known mop bases available on the market. The prior art discloses many different alternatives for having mop bases. However, there is a long felt but unfulfilled need for having a better mop base that the prior art does not accomplish. The conventionally known prior art discloses a variety of mop bases such as mop bases that are incapable of flexing at all or flexing the way the present invention does. Furthermore, there are mop bases that have mop bases that are capable having extensions attached to them. However, there are no mop bases that are capable of cleaning different shape surfaces like the present invention can. The present invention supercedes all of prior art by providing features that are novel, useful and non-obvious to one skilled in the art.

In the description of the present invention, specific terms and references to the drawings are used to better describe and illustrate the present invention. However, one skilled in the art must understand that the present invention is not limited to the descriptions, illustrations and the specific terms presented in the description. The present invention is hereby limited by the prior art and the claims herewith appended. The illustrations, specific terms and descriptions are used for the purposes of presentation, description, illustration and better understanding of the present invention.

There are several U.S. Patents currently available, however, none of them address the long felt need that the present invention fulfills. The following is a brief summary of that prior art.

U.S. Pat. No. 3,085,271 to Janssen discloses a collapsible mop holder for holding a double pocket swab having a pair of opposed, curved, foldable U-shaped wings with the bight of the wings outer, a hinge between the wings and to which the wings are secured. One of the wings is longer than the other. A pair of reinforced struts integrally mounted on the longer of said wings transverse to the longitudinal axis of said wing. Furthermore, a center bar on a longer wing is mounted integrally at one end to the bight of the U-shaped portion and free at the other end above the hinge. A center bar at the shorter end is mounted integrally at one end to the bight of the U-shaped portion of the wing and free at the other end above the hinge. There is also a mop handle socket which is freely rotatable on the longer wing center bar. The present invention is a flexible mop base having a flat base layer fabricated from a hard material such as a plastic and an absorption layer attached to the flat base layer. Furthermore, one of the ends of the flat base can be rotated so that it can accommodate different types of surfaces. The rotation angle does not exceed ninety degrees of arc. The mechanism consists of a hinge and two stopper located on that hinge preventing that end from rotating more than ninety degrees in either direction. Finally, the mop base contains a handle attachment mechanism. The attachment mechanism has a socket that is can freely rotates in at least two directions.

U.S. Pat. No. 4,991,250 to Young discloses a mop pad holder having attachment means for the attachment of a mop pad and for the separate attachment of a sheet of wiping or polishing material. The mop pad has apertures that can lock in the attachment material and secure it. The present invention is a flexible mop base having a flat base layer fabricated from a hard material such as a plastic and an absorption layer attached to the flat base layer. Furthermore, one of the ends of the flat base can be rotated so that it can accommodate different types of surfaces. The mop base contains a handle attachment mechanism. The attachment mechanism has a socket that is can freely rotates in at least two directions.

U.S. Pat. No. 5,253,387 to Kresses et al. teaches a mop head having two flaps which can be folded back upon each other. The mop head includes two pouches on its upper side and an additional securing device allocated t one pouch. A system is provided to facilitate the securing of the strap to the end of the flap in the locked position. The system's securing device is a strap or retaining plate having two elongated holes or slots, the plate being fitted to a fabric covering of the mop head at its short end, with screw-head-like projecting securing means corresponding to the elongated holes on one of the flaps, whereby the elongated holes have a longitudinal extension permitting insertion in the pouch, on the relative movement of the flap and strap, and the securing means lie against the edge of the elongated hole towards the short end with the mop head secured in the operative position, and lie against the edge of the elongated hole towards the handle when the flaps are folded. The present invention is a flexible mop base having a flat base layer fabricated from a hard material such as a plastic and an absorption layer attached to the flat base layer. Furthermore, at least one of the ends of the flat base is capable of rotation. The mechanism consists of a hinge and two stoppers located on that hinge preventing the ends from rotating more than ninety degrees in either direction. Finally, the mop base contains a handle attachment mechanism. The attachment mechanism has a socket that is can freely rotates in at least two directions.

While the prior art is of a significant interest, it does not address the specific need that the present invention accomplishes. The present invention provides a convenient way of having a flexible mop base that is capable of being adjusted to several different surfaces. The mop base has at least one flexible end that is capable of cleaning surfaces that are perpendicular to a crossing surface.

SUMMARY OF THE INVENTION

The present invention is directed to a flexible mop base.

Another object of the present invention is to have a flexible mop base having at least one end that is capable of flexing.

Another object of the present invention is to have a flexible mop base having a hard top layer to which an absorption layer is attached.

Another object of the present invention is to have a flexible mop base having a flexing mechanism with two stoppers permitting rotation of the mop base end up to a certain degree.

Another object of the present invention is to have a flexible mop base having a mop holder attachment mechanism capable of free rotation in several directions.

BRIEF DESCRIPTION OF THE DRAWINGS

The present invention would be better understood in conjunction with the following drawings. It is understood by one skilled in the art that these drawings are in no way to create limitations on the present invention, other than those created by the prior art and the provided description and claims. The figures depict one of the possible embodiments, however, it is understood by one skilled in the art that other embodiments are possible and there are no limitations to be implied from the shown embodiment.

DETAILED DESCRIPTION OF THE INVENTION

The present invention relates to a flexible mop base having a top layer, preferably fabricated from plastic and a bottom absorption layer, attached to the top layer. Furthermore, the present invention relates to a flexible mop base, wherein at least one of the ends of the mop base is capable of rotation of at most ninety degrees of arc from the plane of the mop base. The present invention is capable of cleaning several different types of surfaces, which may be positioned up to ninety degrees away from the plane of the mop base. The following is a description of a preferred embodiment.

Figure 1:
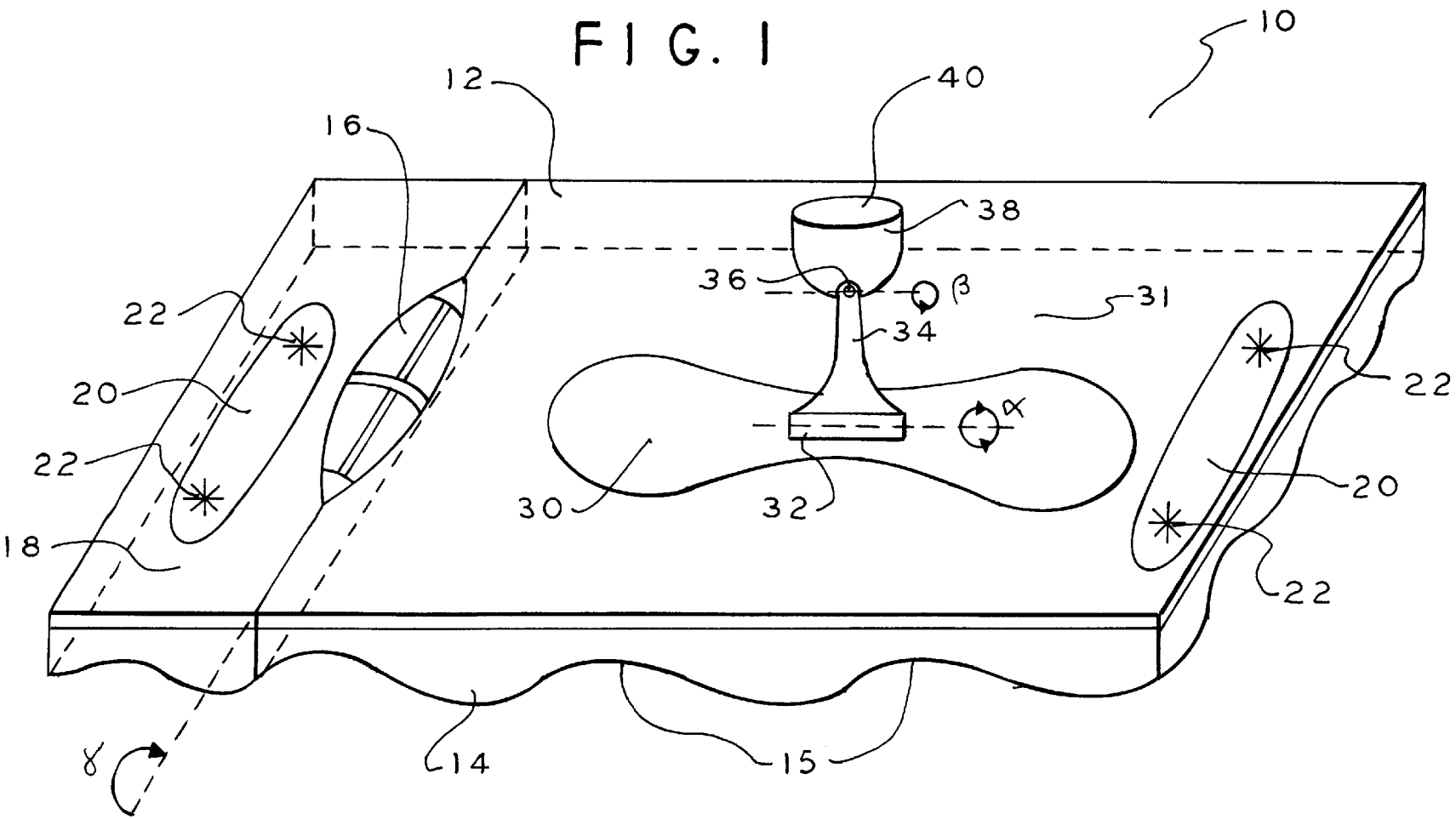
FIG. 1 is perspective view of the present invention showing a top surface of the mop base and a flexing mechanism located at one end of the mop base

Referring to FIG. 1, a flexible mop base 10 is shown to have a top layer 12 and a bottom layer 14. The top layer 12 is preferably fabricated from a solid material such as plastic or any other comparable conventionally known material. The bottom layer 14 is attached to the top layer 12 by means of glue, epoxy or any other known methods. The bottom layer 14 is a fabricated from a soft material that is capable of absorption and easy adjustment to irregularities of the surfaces against which it is pressed. To ensure easy adjustability of the mop base to the irregularities of the surface, the bottom layer 14 is fabricated from a spongy material having a wavy contours indicated by the grooves 15 on FIG. 1. Such contour assures that the mop base 10 will reach all irregularities of the surface it is designed to clean.

Referring to FIG. 1, an embodiment of the mop base 10 is shown to have a rectangular shape, however, it is assumed by one skilled in the art that other shapes of the mop base 10 are possible. In the shown preferred embodiment, the mop base 10 is shown to have one flexible end 18. However, it is assumed by one skilled in the art that other combinations of flexible ends are possible. The flexible end 18 is attached to the mop base 10 with a rotation mechanism 16, shown in more detail in FIG. 4. The rotation mechanism 16 permits rotation of the flexible end 18 around axis $\gamma$. The flexible end 18 can be rotated in a clockwise direction, so that it is perpendicular to the surface of the mop base 10. To return it in its original position, the flexible end 18 is rotated in the counterclockwise direction around axis $\gamma$ and, thus, assumes a horizontal position aligning with the plane of mop base 10.

Figure 4:
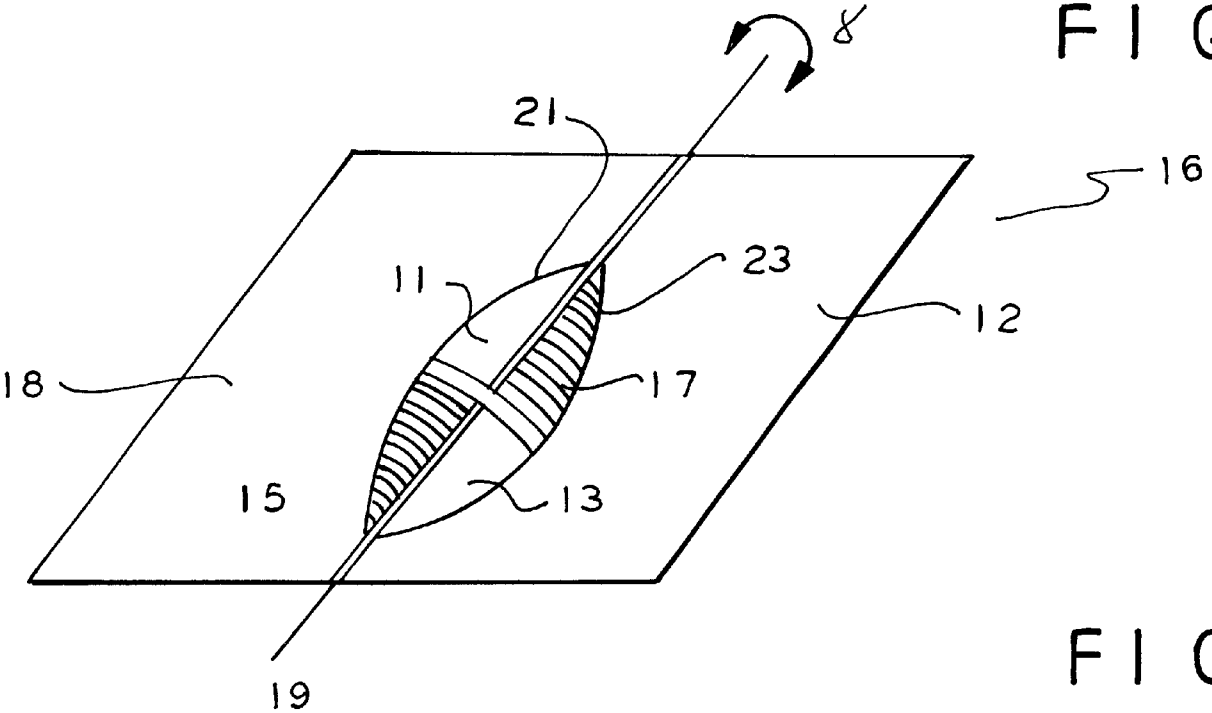
FIG. 4 is a perspective view of the present invention's flexing mechanism.
Figure 4A:
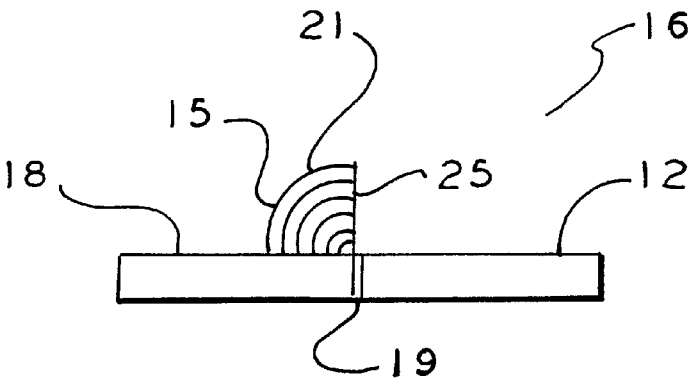
FIG. 4*a* is a projection view of the present invention's attachment mechanism.

Referring to FIG. 4, the rotation mechanism 16 is shown to be positioned on the separation axis 19, with a first part 21 on the flexible end 18 and a second part 23 on the top layer 12. The first part 21 has first flat member 11 and a first stopper 15 and the second part 23 has a second flat member 13 and a second stopper 17. Referring to FIG. 4*a*, the stopper 15 is shown to have a shape of a quarter sphere and having a side 25, which is perpendicular to the surface of the top layer 12 and flexible end 18. The stopper 17 has a similar structure described above in conjunction with stopper 15. Therefore, when the flexible end 18 is rotated in a clockwise direction, the side 25 of the stopper 15 comes in contact with the flat member 13. Similarly, the stopper 17 comes in contact with flat member 11. Upon such contact the flexible end 18 assumes a vertical position with respect to the top layer 12. A rotation of the flexible end 18 in the counterclockwise direction the first stopper 15 disengages with the second flat member 13 and the second stopper 17 disengages with the first flat member 11. The rotation mechanism 16 may be so constructed as to permit flexible end 18 to be positioned not only in the vertical or horizontal position with respect to the top layer 12, but at any angle between vertical and horizontal position of the flexible end 18.

Referring to FIG. 1, the flexible mop base 10 is shown to have cleaning cloth holder bases 20 with cleaning cloth holder sockets 22. Depending on the surface that is being cleaned, a user of the flexible mop base 10 might desire to use a different type of cleaning cloth and, therefore, instead of putting on a cleaning casing 50, as shown in FIG. 3, the user may wrap a cleaning cloth around the bottom layer 14 and attach it to the cleaning cloth sockets 22 by pushing ends of the cleaning cloth into the sockets 22.

Figure 2:
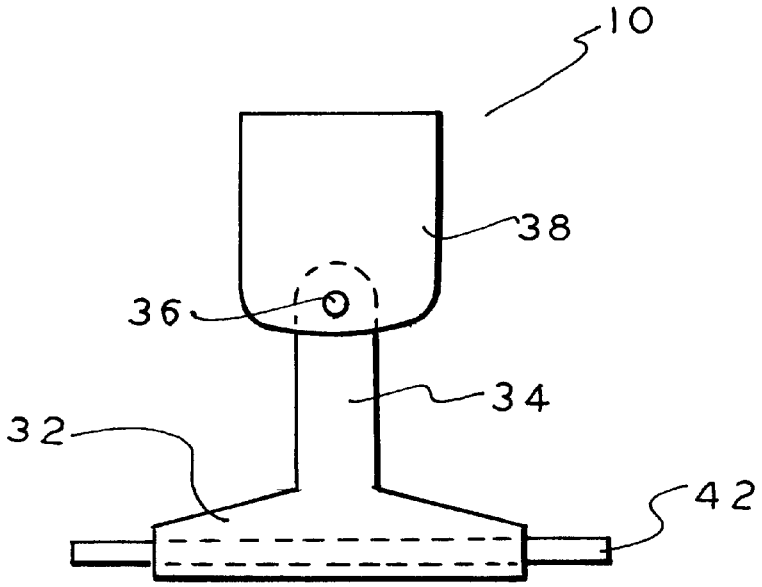
FIG. 2 is projection view of the present invention showing mop holder attachment mechanism.

Referring to FIGS. 1 and 2, the flexible mop base 10 is shown to have a mop base handle 31. The mop base handle 31 has a base 30, rotational arm 34 and a socket 38. The rotational arm 34 is attached to a base rotational axis 42, which allows the rotational arm 34 to be rotated around axis $\alpha$, which is perpendicular to the axis $\gamma$. The base rotational axis 42 permits semicircular movement of the arm 34. A bottom portion 32 of the rotational arm 34 is attached to the base rotational base axis 42 using a snap on method. Furthermore, the rotational arm 34 and the socket 38 are attached with socket rotational axis 36, as shown in FIGS. 1 and 2. The socket rotational axis 36 permits rotation of the socket 38 around an axis $\beta$, which is perpendicular to axis $\alpha$. The socket rotational axis 36 permits approximately full circular movement of the socket 38, as shown in FIGS. 1 and 2.

Figure 3:
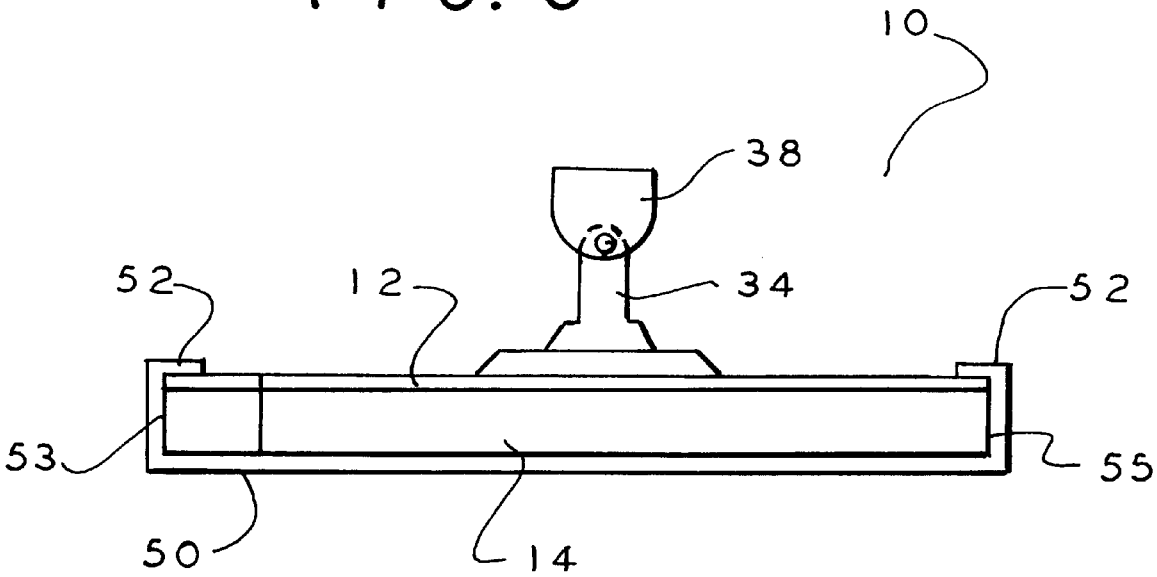
FIG. 3 is a projection view of the present invention wherein a cleaning case is attached to the mop base.

Referring to FIG. 3, the flexible mop base 10 is shown with a cleaning casing 50. The cleaning casing has pocket sections 52, which are placed over flexible mop base ends 53 and 55. The cleaning casing 50 may be fabricated from any conventionally known cloth or any other material. After cleaning, the casing 50 may be removed and either washed or discarded.

In the foregoing description, references to drawings and specific terms are used for descriptive purposes only and not to be construed as limiting the present invention to such. It is understood by one skilled in the art that the present invention is limited only to the prior art referenced above and the claims appended therein. The use of the drawings and specific terms is for the purposes of presentation, illustration and general comprehension only. Moreover, the drawings and the specific terms used are intended to be broadly construed and in no way limit the present invention.

It is, also, understood by one skilled in the art that other embodiments are possible as long as they are a reasonable interpretation of the appended claims and the disclosure above. Any and all changes or modifications to the present invention are feasible as long as they are within the scope and spirit of the appended claims.

What is claimed:

1. A flexible mop base comprising:

a) a top layer;

b) at least one flexible end attached to said top layer;

c) a bottom absorption layer attached to a lower surface of the top layer and said flexible end;

d) a mop handle means attached to an upper surface of said top layer; and e) an attachment mechanism used to attach said flexible end to said top layer such that the flexible end is pivotally movable between a first position wherein it is substantially coplanar with said top layer and a second position wherein it is pivoted toward the upper surface of the top layer and oriented at an angle of about 90 degrees relative to said top layer, the attachment mechanism further including at least one part, the at least one part limiting the travel of the flexible end to said second position.

2. The flexible mop base of claim 1, wherein said top layer is fabricated from plastic.

3. The flexible mop base of claim 1, wherein said bottom absorption layer is fabricated from a soft material configured for absorption.

4. The flexible mop base of claim 1, wherein said flexible mop base has one flexible end.

5. The flexible mop base of claim 1, wherein said flexible mop base has two flexible ends.

6. The flexible mop base of claim 1, wherein said flexible end is configured for rotating ninety degrees of arc in a direction generally towards the mop handle means.

7. The flexible mop base of claim 1, wherein said attachment mechanism further comprises of a first stopper means and a first flat member and a second stopper means and a second flat member.

8. The flexible mop base of claim 7, wherein when said flexible end is in said second position, said first stopper means comes into direct contact with said second flat member and said second stopper means comes into direct contact with said first flat member, thereby seizing further rotation of said flexible end.

9. The flexible mop base of claim 1, wherein said top layer further comprises a pair of cleaning cloth-holding means.

10. The flexible mop base of claim 9, wherein said cloth holding means are capable of holding a cleaning cloth.

11. The flexible mop base of claim 1, further including a cleaning casing, the cleaning casing being removably positionable on the flexible mop base.

12. The flexible mop base of claim 11, wherein said cleaning casing further comprises pockets, wherein said pockets are placed over ends of said flexible mop base.

13. The flexible mop base of claim 1, wherein said handle means further comprise of a handle base means attached to said top layer, a rotational arm attached to said handle base means, a mop holder socket means attached to said rotational arm.

14. The flexible mop base of claim 13, wherein said rotational arm is attached to said handle base means through a base rotational axis means.

15. The flexible mop base of claim 13, wherein said mop holder socket means is attached to said rotational arm through a socket rotational axis means.

16. A flexible mop base comprising:

a) a planar top layer b) at least one planar flexible end attached to said top layer;

c) a bottom absorption layer attached to a lower surface of the top layer and said flexible end;

d) a mop handle means attached to an upper surface of said top layer, wherein said handle means further includes a handle base means attached to said top layer; and e) an attachment mechanism used to attach said flexible end to said top layer such that the flexible end is pivotally movable between a first position wherein it is coplanar with the top layer and a second position wherein it is pivoted toward the upper surface of the top layer and oriented at an angle relative to the top layer, said attachment mechanism further includes a first stopper means and a first flat member positioned on the flexible end and a second stopper means and a second flat member positioned on the top layer, said stopper means and flat members of the attachment mechanism cooperating to limit rotation of the flexible end to said second position flexible end is in said second position.

17. The flexible mop base of claim 16, wherein when said flexible end is in said second position, said first stopper means comes into direct contact with said second flat member and said second stopper means comes into direct contact with said first flat member, thereby seizing further rotation of said flexible end.

18. The flexible mop base of claim 16, wherein a rotational arm is attached to said handle base means, said rotational arm being attached to said handle base means through a base rotational axis means.

19. The flexible mop base of claim 18, wherein a mop holder socket means is attached to said rotational arm, said mop holder socket means being attached to said rotational arm through a socket rotational axis means.

20. The flexible mop base of claim 16, wherein the flexible end has a width and the width defines an edge, the top layer has a width and the width defines an edge, the edge of the flexible end and the edge of the top layer being hingedly connected and defining an axis of rotation between the flexible end and the top layer.

* * * * *